United States Patent [19]

Hawkins

[11] 4,069,922

[45] Jan. 24, 1978

[54] PORTABLE CRANE WITH HOIST MOUNTING AND OUTRIGGER SUPPORT APPARATUS

[76] Inventor: Wallace H. Hawkins, Rte. 7, Buncombe Road, Greenville, S.C. 29609

[21] Appl. No.: 629,588

[22] Filed: Nov. 6, 1975

[51] Int. Cl.[2] ..... B66C 23/06

[52] U.S. Cl. ..... 212/59 R; 212/55; 212/145; 214/77 R

[58] Field of Search ..... 212/8 R, 59 R, 144–145, 212/55, 28; 214/75 R, 77 R, 147 R

[56] References Cited

U.S. PATENT DOCUMENTS

| | | | |
|---|---|---|---|
| 3,384,253 | 5/1968 | Wood | 212/59 R |
| 3,661,274 | 5/1972 | Woodside et al. | 212/59 R |
| 3,752,328 | 8/1973 | Balogh | 212/145 |
| 3,792,778 | 2/1974 | Sholl et al. | 212/55 |

*Primary Examiner*—Robert J. Spar
*Assistant Examiner*—R. B. Johnson
*Attorney, Agent, or Firm*—Bailey, Dority & Flint

[57] ABSTRACT

An apparatus for supporting a hoist mounted on a frame of a pick up truck is illustrated wherein an auxiliary or supplemental support leg is provided outboard of the vehicle for supporting the hoist mechanism. The auxiliary support is provided by positioning an oscillable collar on a vertical hoist supporting column carried by the vehicle and providing a laterally extending arm fixed to the collar for carrying a vertically adjustable support leg thereon.

5 Claims, 2 Drawing Figures

PORTABLE CRANE WITH HOIST MOUNTING AND OUTRIGGER SUPPORT APPARATUS

BACKGROUND OF THE INVENTION

It is desirable to equip a vehicle such as a four-wheel pickup truck having a rear loading compartment with a hoist mechanism for loading and unloading the truck but such has heretofore proved impractical because of the obstruction created if the hoist is centrally located. If the hoist is mounted adjacent a corner of the truck body, excessive unbalanced loads are placed on the wheels. No matter where the hoist is located, if the loads are relatively heavy, the wheel structure of the vehicle is overloaded.

Hoist supports of the outrigger type have been provided heretofore such as, for example, those illustrated in U.S. Pat. Nos. 2,741,373 and 3,784,035. Such arrangements contemplate the use of transverse hoist supporting mechanisms which afford support at each end on legs carried outboard of the vehicle. Structures of this type would be difficult to manipulate in a four-wheel truck and could not be readily disassembled and placed in the loaded vehicle for transport after use. Other auxiliary supports are provided for supporting the boom itself such as those illustrated in U.S. Pat. No. 3,780,878.

Accordingly, it is an important object of this invention to provide a hoist mounting and support means permitting a hoist to be mounted adjacent a rear corner of a truck body with an auxiliary support to prevent excessive unbalanced loading on the wheel structure and which may be readily disassembled and placed in the vehicle after it is unloaded.

SUMMARY OF THE INVENTION

It has been found that means for mounting the hoist as in a corner of a truck body may be provided for affording supplemental support by oscillatably positioning a collar on the hoist support, said collar having an arm extending outboard of the vehicle adjustably positioning an upright leg adjacent a free end thereof affording auxiliary support to the hoist.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
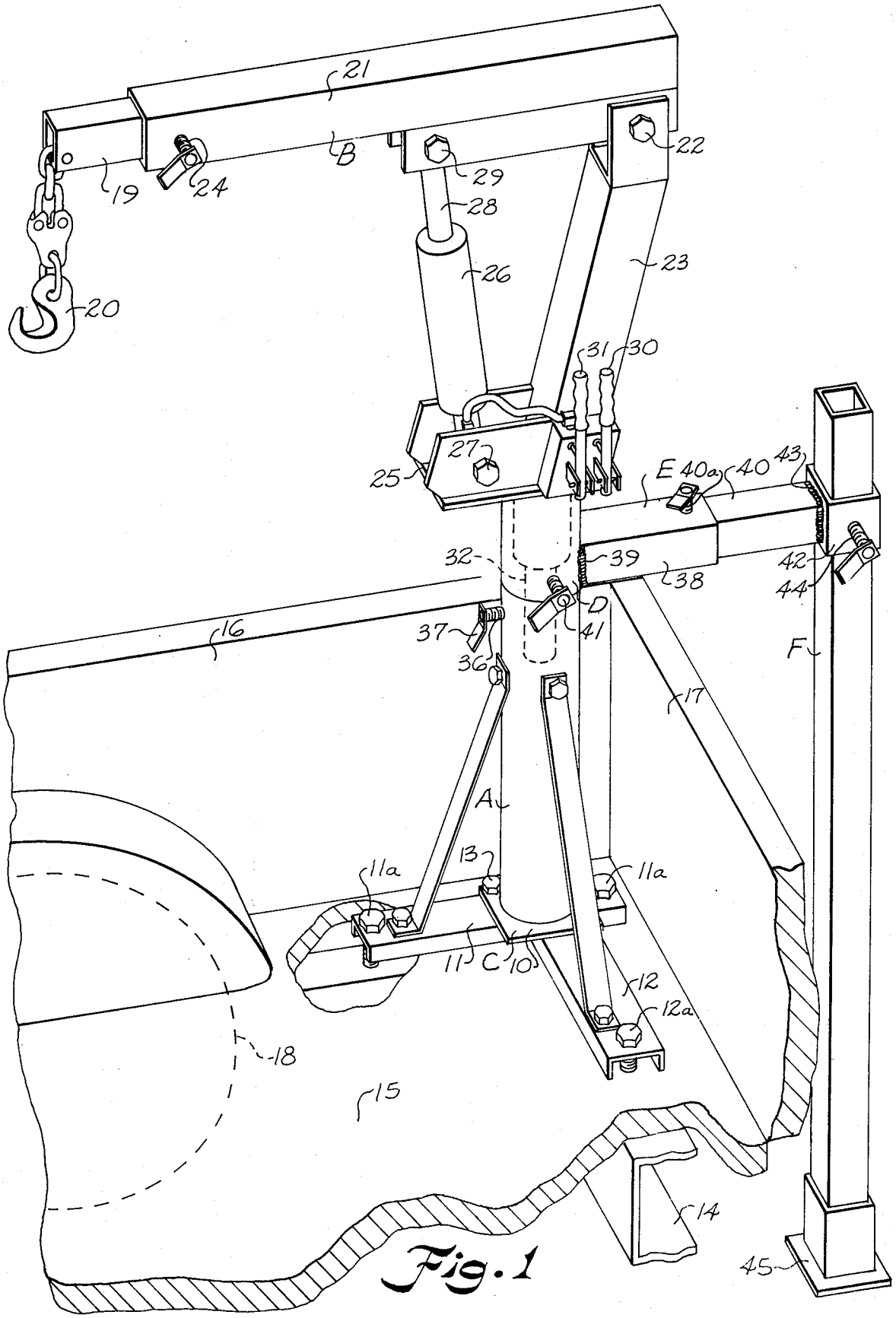
FIG. 1 is a perspective view illustrating a hoist mounting and support apparatus constructed in accordance with the present invention positioned adjacent the rear corner frame portion of a four-wheel truck.
Figure 2:
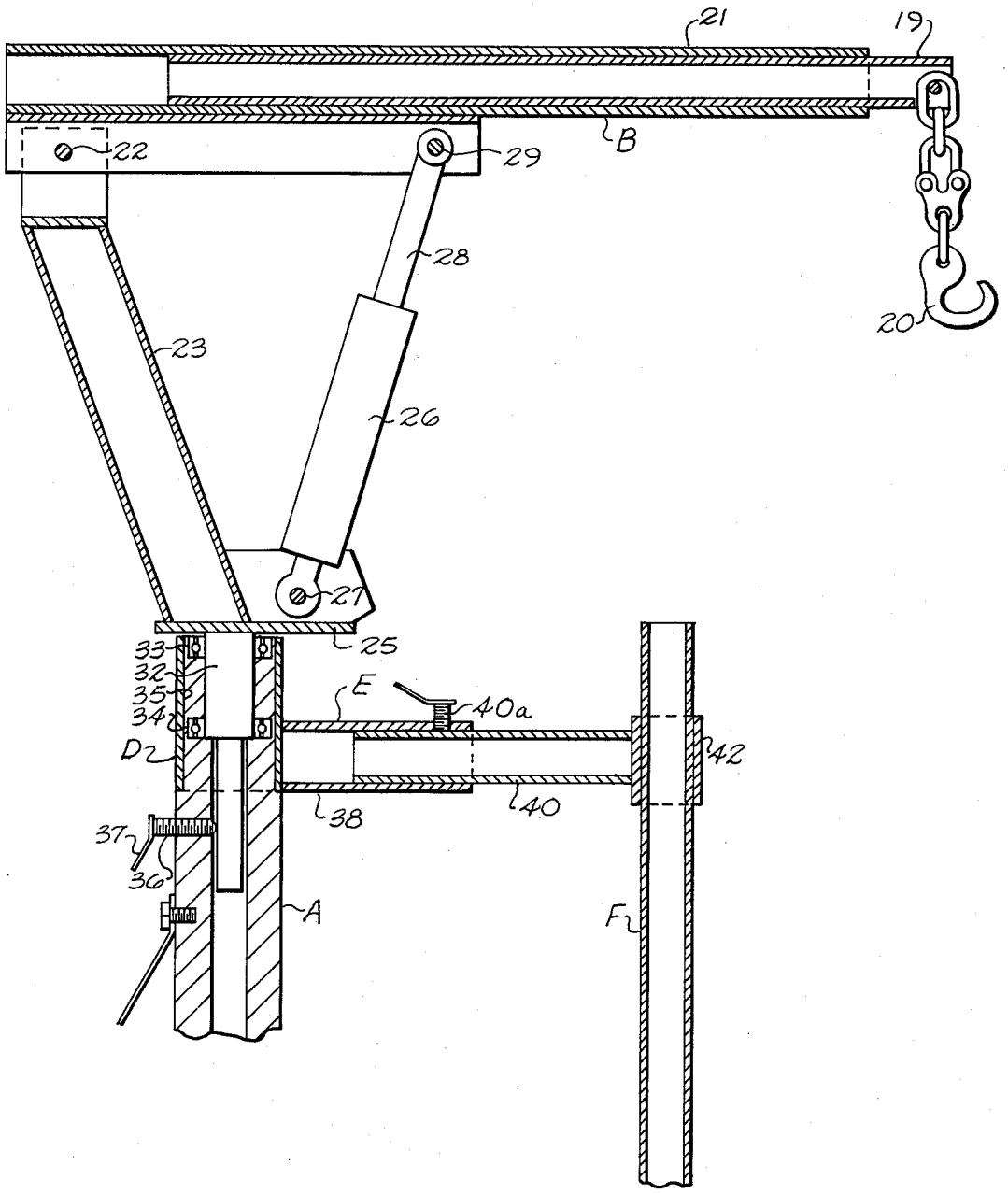
FIG. 2 is a longitudinal sectional elevation of the hoist mounting and auxiliary support structure constructed in accordance with the present invention.

The drawings illustrate apparatus for supporting a hoist mounted on a frame of a wheeled vehicle. The hoist has an upright support column A carrying an outwardly extending boom B with load engaging means adjacent an outer end thereof. Means C are provided for mounting the support columm in fixed relation to the vehicle frame. A collar D, restrained against vertical movement, is mounted on the column for oscillatory movement thereon. A laterally extending arm E is fixedly carried adjacent one end thereof by the collar. An upright leg F is carried for vertical adjustment adjacent the other end of the arm outboard of the vehicle. Thus, a load supported by the boom is transmitted to the leg thereby providing a supplemental support which may be readily dismantled and placed within the vehicle.

The upright support column A carries the boom B in such a manner that the boom may be oscillatably adjusted thereabout in any desired position to engage a load external to the truck for loading the truck. The means C which are provided for supporting the column A include a base plate 10 which is suitably secured to a pair of inverted channel-shaped supports 11 and 12 as by bolts 13. The inverted channels 11 and 12 are preferably disposed in right angle relation to each other for fastening to a corner portion of the truck frame 14 as by bolts **11*a* and 12*a*. It will be observed that the truck has a bed 15, overlying and carried by the frame 14, provided with side and rear end members 16 and 17, respectively. The truck bed is supported by wheels 18** carried adjacent each side of the truck bed.

The boom B has a telescoping extensible portion 19 which carries a suitable load engaging means 20. The extensible portion 19 is telescopingly mounted within an arm 21 which is pivotally carried as at 22 upon a vertical standard 23. The extensible portion 19 may be secured with respect to the pivoted portion 21 by a threaded shank member 24 which is threadably carried by the pivoted portion 21 so as to forcefully engage the extensible member 19 on an inner end thereof.

The standard 23 is carried by a horizontal mounting plate 25 which is oscillatably carried upon the column A. A fluid operated cylinder 26 is provided for raising and lowering the boom. One end of the cylinder has pivotal connection as at 27 with the horizontal support plate 25. A piston rod 28 extends outwardly from the other end of the cylinder 26 remote from the pivotal mounting 27. The piston rod has pivotal connection as at 29 with the boom B. Manually operated pumping mechanims are illustrated at 30 and 31, one being for high speed elevation of the boom B and the other being provided for slow high-powered movement thereof.

It will be noted that the horizontal mounting plate 25 has fixed connection with a depending portion 32 of reduced diameter carried upon thrust bearings 33 and 34 within the column A. The column A has an upper collar receiving portion 35 of reduced diameter. Thus, the collar is carried for oscillation on the column A but is confined thereon against axial movement up and down on the column A since it is mounted on a reduced portion 35 and confined thereon by the mounting plate 25.

It will be observed that a threaded shank portion 36 is provided with a handle 37 for turning the inner end of the threaded shank portion into engagement with the depending portion 32 to fix the boom against turning movement with respect to column A.

The collar D has a laterally extending arm E which includes a portion 38 which has fixed connection to the column as by welding at 39. An extensible portion 40 is telescopically carried therein and is provided with a threaded shank **40*a* for fixing the telescoping arm portions 38 and 40 in an adjusted fixed position. A threaded shank 41** is carried by an internally threaded portion of the collar D for fixing the collar against rotation on the column A.

The leg F has adjustable vertical support within the laterally extending arm E adjacent an outer end thereof. A rectangular housing 42 has fixed connection with the extensible portion 40 as by welding at 43 and provides a vertical opening for receiving the leg F. A threaded shank portion 44 is provided for fixing the leg in adjusted position with respect to the laterally extending arm E. The leg F has a suitable base member 45 for engaging the ground or load carrying surface.

While a preferred embodiment of the invention has been described using specific terms, such description is for illustrative purposes only, and it is to be understood that changes and variations may be made without departing from the spirit or scope of the following claims.

What is claimed is:

1. Apparatus for mounting a hoist on a frame of a wheeled pickup truck vehicle, said hoist having an upright support column carrying an outwardly boom with load engaging means adjacent an outer end thereof comprising:

means mounting said support column in fixed relation to said vehicle frame;

means for rotatably mounting said boom on said column about a vertical axis;

a collar mounted on said column for oscillatory movement thereon adjacent an upper end thereof about said vertical axis;

a laterally extending arm fixedly carried adjacent one end thereof by said collar;

a substantially vertical housing carried by said arm adjacent the other end thereof;

a substantially vertical support leg carried for vertical adjustment in said housing outboard of said vehicle; and means for laterally adjusting said housing relative to said arm;

whereby a load supported by said load engaging means is transmitted to said leg which is selectively positionable to a plurality of load supporting positions by rotation of said collar thereby providing a supplemental support for the load which may be readily dismantled and placed within the vehicle.

2. The apparatus set forth in claim 1 wherein said frame has a rear corner portion adjacent a rear corner portion of said vehicle and said means mounting said support column includes, a base, and fastening means carried by said base for attachment to said rear corner portion of said frame.

3. The apparatus set forth in claim 1 including, a rotatable mounting carried by said support column above said collar, an upright standard fixedly carried by said rotatable mounting, means pivotally mounting said boom adjacent an upper end of said standard, and a fluid operated cylinder having pivotal connection to said boom for raising said boom and a load carried thereby.

4. The apparatus set forth in claim 1 wherein said arm includes adjustably positioned telescoping members.

5. Apparatus for mounting a hoist having an outwardly extending boom on a wheeled vehicle comprising:

an upright support column;

means mounting said support column on said wheeled vehicle;

a boom rotatably mounted on said column for movement about a vertical axis;

a collar, means mounting said collar against vertical movement, means mounting said collar on said column for oscillatory movement thereon about said vertical axis;

a laterally extending arm fixedly carried adjacent one end thereof by said collar;

a substantially vertical housing carried by said arm adjacent the other end of said arm;

a substantially vertical support leg carried for vertical adjustment in said housing outboard of said vehicle and selectively positionable to a plurality of load supporting positions by rotation of said collar;

means for laterally adjusting said housing relative to said arm;

a rotatable mounting carried by said support column above said collar;

an upright standard fixedly carried by said rotatably mounting;

means pivotally mounting said boom adjacent an upper end of said standard; and a fluid operated cylinder having pivotal connection to said boom for raising said boom and a load carried thereby.

* * * * *